US012275512B1

(12) United States Patent
Ali Lebab et al.

(10) Patent No.: US 12,275,512 B1
(45) Date of Patent: Apr. 15, 2025

(54) ROBOTIC FISH

(71) Applicant: KING FAISAL UNIVERSITY, Al Hasa (SA)

(72) Inventors: Idris Homed Idris Ali Lebab, Al Hasa (SA); Abdal Halim Musa Yagoub Abdalrazig, Al Hasa (SA)

(73) Assignee: KING FAISAL UNIVERSITY, Al Hasa (SA)

( * ) Notice: Subject to any disclaimer, the term of this patent is extended or adjusted under 35 U.S.C. 154(b) by 103 days.

(21) Appl. No.: 18/395,071

(22) Filed: Dec. 22, 2023

(51) Int. Cl.

| | |
|---|---|
| ***B63H 1/36*** | (2006.01) |
| ***B63H 23/14*** | (2006.01) |
| *B63H 5/00* | (2006.01) |
| *B63H 25/46* | (2006.01) |

(52) U.S. Cl.
CPC ..... *B63H 23/14* (2013.01); *B63H 1/36* (2013.01); *B63H 2005/005* (2013.01); *B63H 25/46* (2013.01)

(58) Field of Classification Search
CPC ..... B63H 23/14; B63H 1/36; B63H 25/46; B63H 2005/005
See application file for complete search history.

(56) References Cited

U.S. PATENT DOCUMENTS

| | | | |
|---|---|---|---|
| 4,687,456 | A | 8/1987 | Wang |
| 6,439,949 | B1 | 8/2002 | Lucas et al. |
| 11,208,186 | B2 | 12/2021 | Yu et al. |

FOREIGN PATENT DOCUMENTS

| | | | | |
|---|---|---|---|---|
| CN | 112407213 A | * | 2/2021 | |
| CN | 110626482 B | | 3/2021 | |
| CN | 113148087 A | * | 7/2021 | ..... B63C 11/52 |

OTHER PUBLICATIONS

Song, Zhibin, et al. "A novel fish-inspired robot with a double-cam mechanism." Machines 10.3 (2022): 190.
Zhong, Yong, Zheng Li, and Ruxu Du. "Robot fish with two-DOF pectoral fins and a wire-driven caudal fin." Advanced robotics 32.1 (2018): 25-36.

* cited by examiner

*Primary Examiner* — Andrew Polay
(74) *Attorney, Agent, or Firm* — Nath, Goldberg & Meyer; Joshua B. Goldberg

(57) ABSTRACT

A robotic fish includes a pair of rear lateral gears controlling a rear portion of the robotic fish, and a pair of front lateral gears control a front portion of the robotic fish. A pair of right side lateral gears control a right pectoral side of the robotic fish, and a pair of left side lateral gears control a left pectoral side of the robotic fish.

5 Claims, 10 Drawing Sheets

ROBOTIC FISH

BACKGROUND

1. Field

The present disclosure relates to robotics, and particularly to simulating marine and terrestrial life using robotics.

2. Description of the Related Art

There is a need for devices that can be used to search the depths of oceans, seas and rivers to identify places of pollution and volcanic activities, for exploration, archaeology, marine shielding, maritime protection and other such uses.

SUMMARY

Mechanical devices that mimic animals, especially gear-driven robotic fish are useful because they can maneuver well in tight spaces by avoiding objects from the sides. The mechanical part or aspect of the robotic fish can be designed to move the tail, pectoral fins, and head like a fish. The movement of each part, such as the tail, pectoral fins and head can be separated to move individually.

The separate movement accomplished by creating an external and internal gear to engage and separate from the overall movement to remain in some other parts.

The tail and pectoral fins can be used to change direction of movement of the robotic fish. As for the tail to change direction, this will be related to the design of the structure. The pectoral fins are also used to lift the fish up, push it forward, or push it down by adding a part to separate and engage the movement and a part to change direction and link it to the oscillatory movement. Additional fins can be added to push left or right, and the direction of thrust in the tail can also be changed. The design avoids objects from the sides by taking advantage of the oscillatory mechanical movement of the two linear gears, and this mechanical part can be applied to robotic lizards as well with some modifications. The robotic fish can be used in several applications, including: searching the depths of the oceans, seas and rivers, which may save lives, protecting ships from sea mines, locating places of pollution, volcanic activities, exploration, antiquities, sea shield, maritime protection, and other uses.

A robotic fish, in one embodiment, includes a pair of rear lateral gears controlling a rear portion of the robotic fish, and a pair of front lateral gears controlling a front portion of the robotic fish. A pair of right side lateral gears control a right pectoral side of the robotic fish, and a pair of left side lateral gears control a left pectoral side of the robotic fish.

The robotic fish further includes a tail on the rear portion of the robotic fish. The tail includes a tail ring gear in communication with the pair of rear lateral gears.

A left pectoral fin is located on the left pectoral side of the robotic fish. The left pectoral fin has a left pectoral ring gear in communication with the pair of left side lateral gears.

Likewise, a right pectoral fin is located on the right pectoral side of the robotic fish. The right pectoral fin has a right pectoral ring gear in communication with the pair of right side lateral gears.

The robotic fish further includes a head on the front portion of the robotic fish. The head has a front ring gear in communication with the pair of front lateral gears.

A robotic fish, in another embodiment, includes a pair of rear lateral gears controlling a rear portion of the robotic fish and a tail on the rear portion of the robotic fish. The tail has a tail ring gear in communication with the pair of rear lateral gears. A pair of front lateral gears control a front portion of the robotic fish;

A head is located on the front portion of the robotic fish. The head has a front ring gear in communication with the pair of front lateral gears.

A pair of right side lateral gears control a right pectoral side of the robotic fish. A right pectoral fin is located on the right pectoral side of the robotic fish. The right pectoral fin has a right pectoral ring gear in communication with the pair of right side lateral gears.

A pair of left side lateral gears controls a left pectoral side of the robotic fish. A left pectoral fin is located on the left pectoral side of the robotic fish. The left pectoral fin has a left pectoral ring gear in communication with the pair of left side lateral gears.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
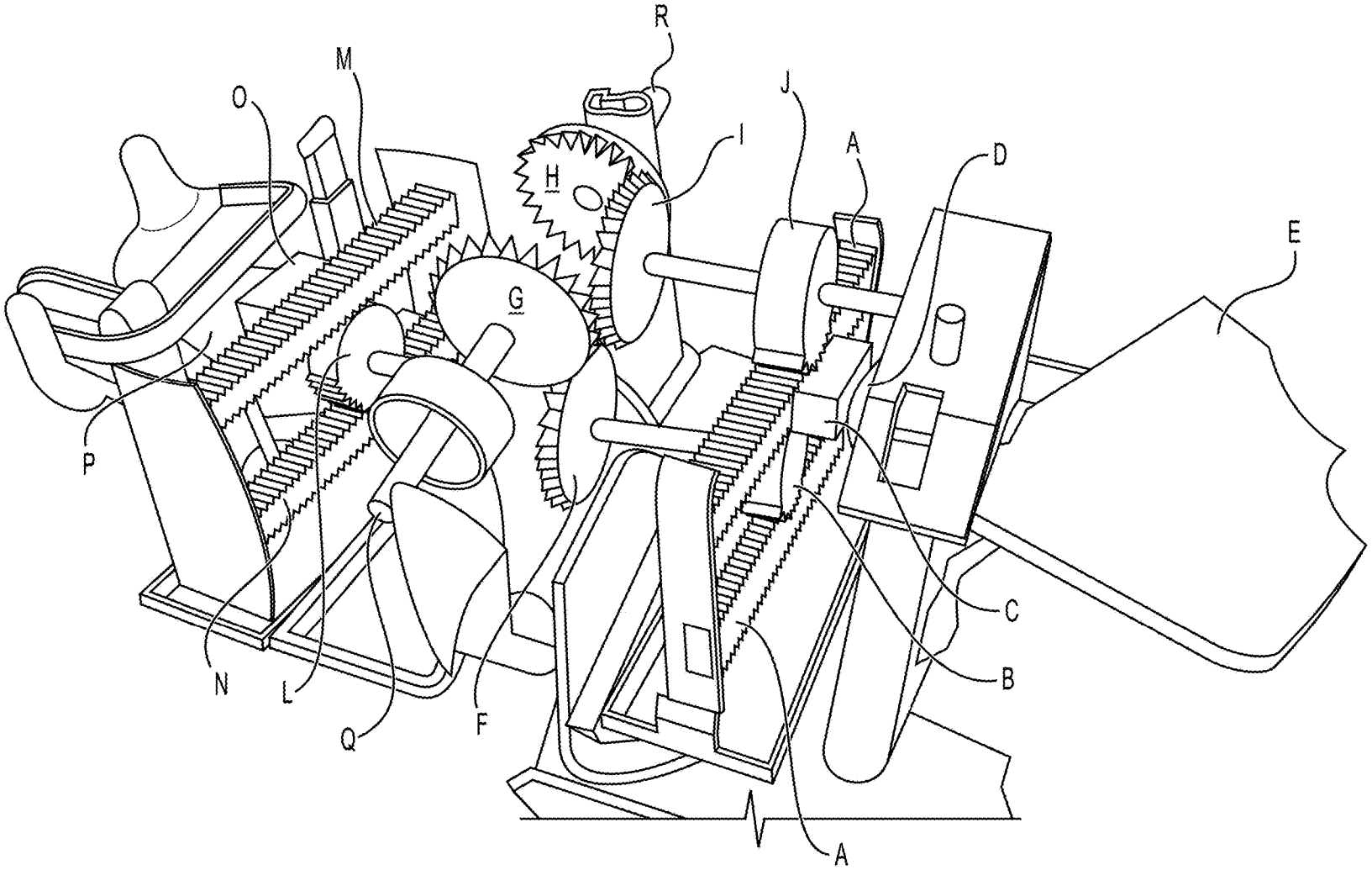
FIG. 1 and FIG. 2 are illustrations showing the gears of a mechanical fish.
Figure 2:
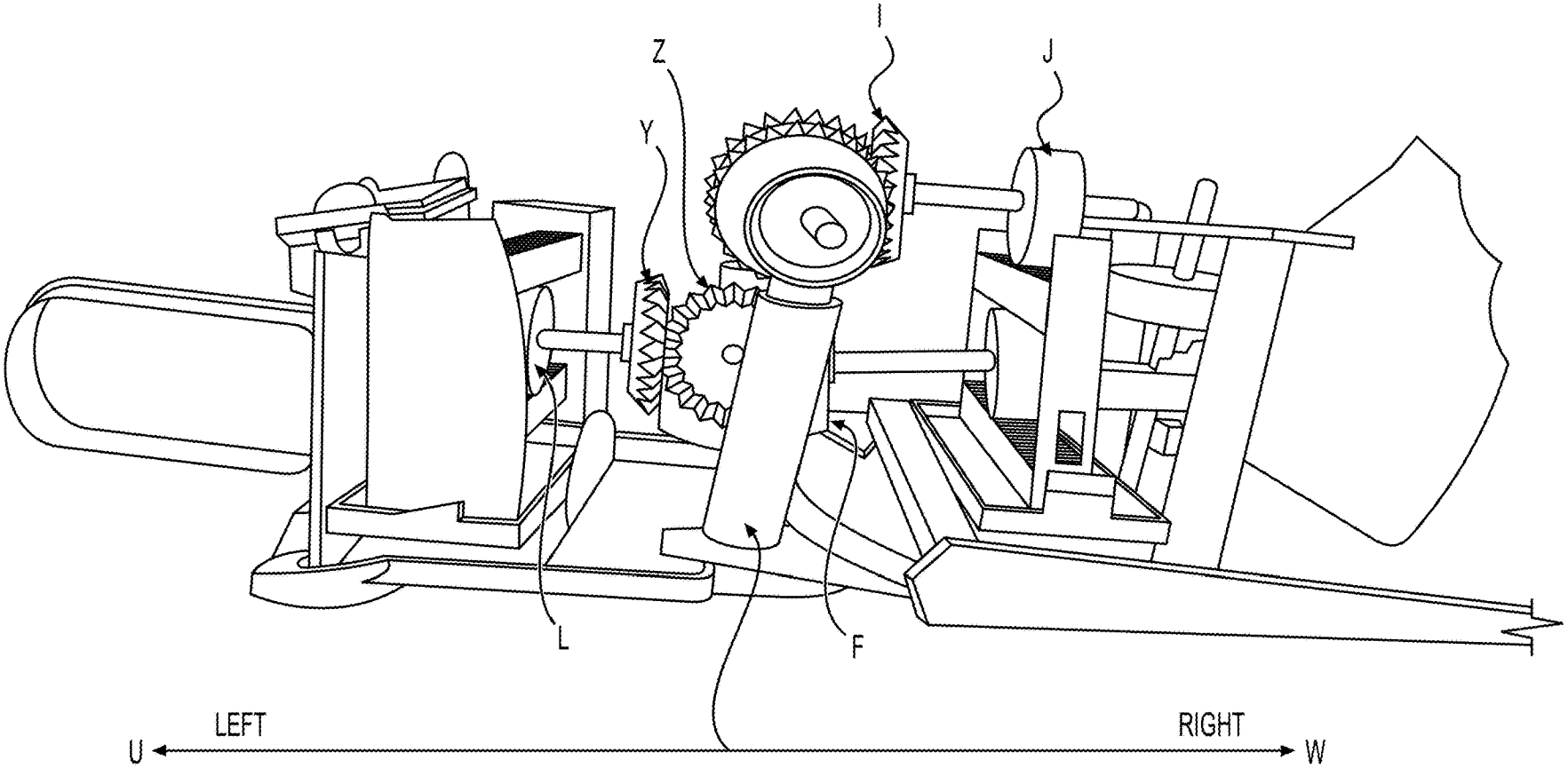

The present subject matter relates generally to mechanical devices that mimic animals, and particularly to a gear-driven robotic fish. As shown in FIG. 1 and FIG. 2, two linear gears A are driven to swing back and forth (horizontally) by a quarter ring gear B. The two linear gears A are linked from the side by a small linear gear C to one of the two linear gears A, which drives the ring gear D that is mounted horizontally and linked with a vertical pole. This vertical pole swings and the fishtail E swings back and forth. The quarter ring gear B is driven to rotate by a bevel gear F, which is driven to rotate by the bevel gear F, which is driven and rotated by the main motor connected to the bevel gear Z, which drives and rotates the lower gear box by mechanical motion. The lower gear box includes 3 bevel gears, F, Z, and Y, knowing that the reciprocating movement results from linear gears driven by a quarter-circular gear, so the bevel gear H and the bevel gear G take the reciprocating movement from the top of the two linear gears A through the circular gear J and the bevel gear I. The bevel gears H, G, and I represent the upper gear box, and this box can be below the lower gear box. The bevel gears H and G are connected to the two externally toothed shafts R and Q, which are the two shafts will provide the pectoral fins with movement, and they are the two shafts that can be modified by adding a system linking the movement and separating the movement in addition to a part to change its direction. The bevel gear Y and the quarter ring gear L in the fish's head work in the same way as the gears F and B work in the tail of the fish. The two linear gears M and N work in the same way as the two linear gears A. The small linear gear O works in the same way as the linear gear C. The ring gear P also works in the same way as the D ring gear.

If pectoral fins are needed, two additional fins can be implemented in each direction. This is done by using a shape similar to the right half (W) of the robotic fish. The right half (W) of the fish, which is the tail part, can be used for the pectoral fins by removing the small linear gear C, the tail E, and the circular gear D, as well as removing the H, G, leaving the circular gear J, and connecting it to a cylindrical shaft (externally serrated). The ring gear J and its toothed shaft can be applied externally above the two linear gears A from the top or below the two linear gears A from the bottom. In addition to that, a system of movement linkage and movement separation is added, in addition to a part to change the direction.

The movement of the fish's head works in a similar way to the tail. The L gear drives the horizontal oscillating motion of the M and N gears. Also, another small linear gear O (similar to linear gear C) is connected to the linear gear M and drives the oscillating movement of the circular gear P, which is installed horizontally and linked to a vertical shaft. The vertical shaft is connected to the head of the robotic fish, which drives the head of the robotic fish to swing.

Figure 3:
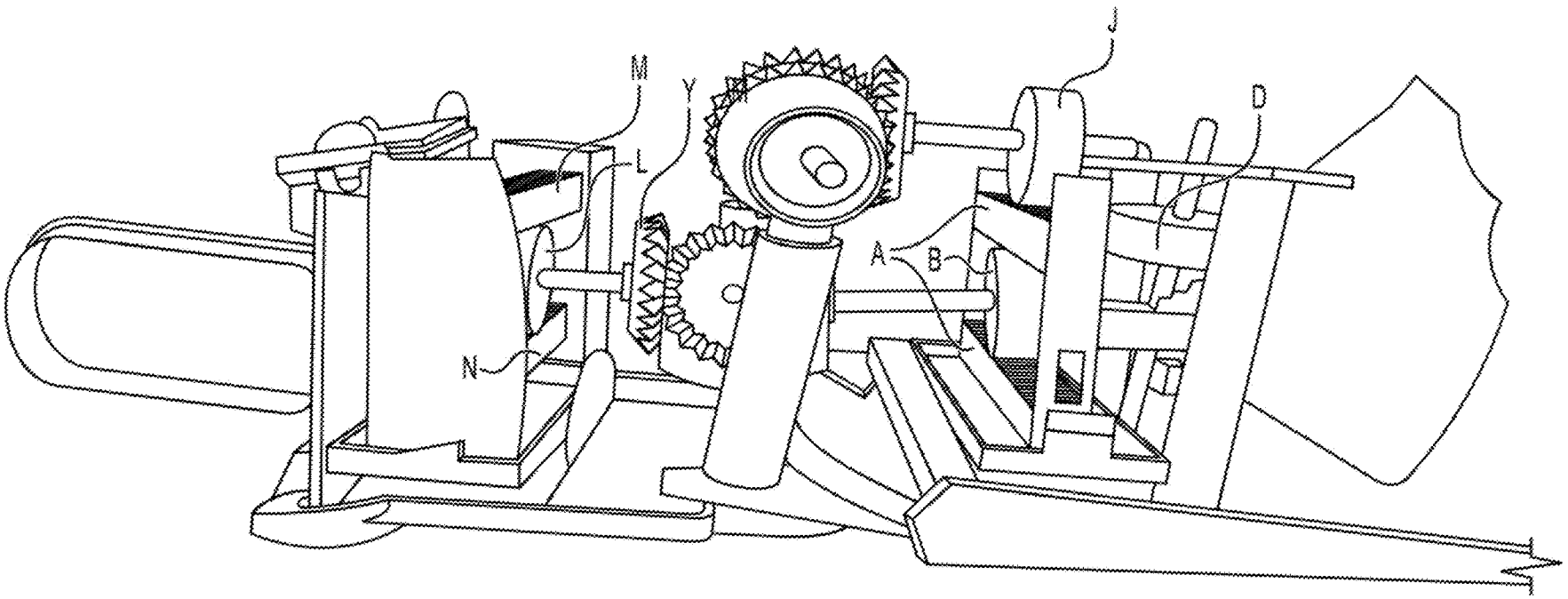
FIGS. 3, 4, 5 and 6 are illustrations showing an alternate design of the mechanical fish.
Figure 4:
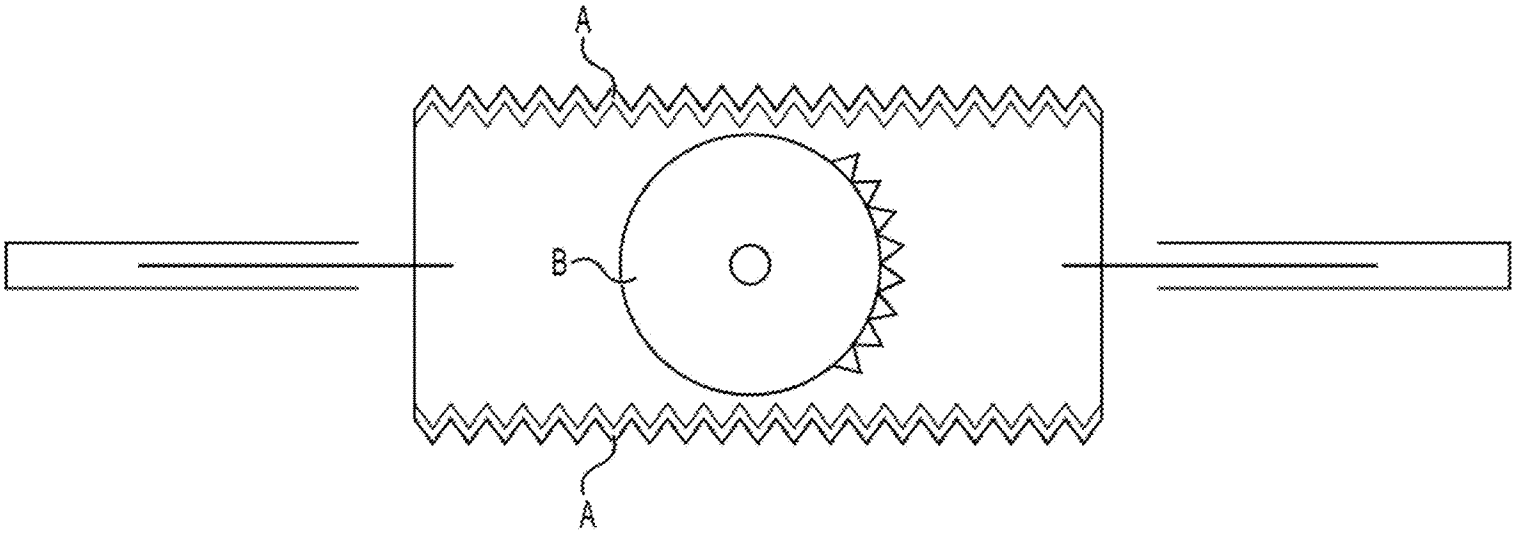

FIG. 3 and FIG. 4 are illustrations of an alternate embodiment of the robotic fish. As shown in FIG. 3, the mechanical movement of the two linear gears is modified by making them mounted on the sides with two shafts and not with a lower or upper track in order to take advantage of the reciprocating movement of the two linear gears from the two sides, which are the upper side and lower side. They can be used in the movement of the pectoral fins, as well as in the horizontal oscillating movement of the two linear gears on the sides to move away from objects (see FIG. 4).

Figure 5:
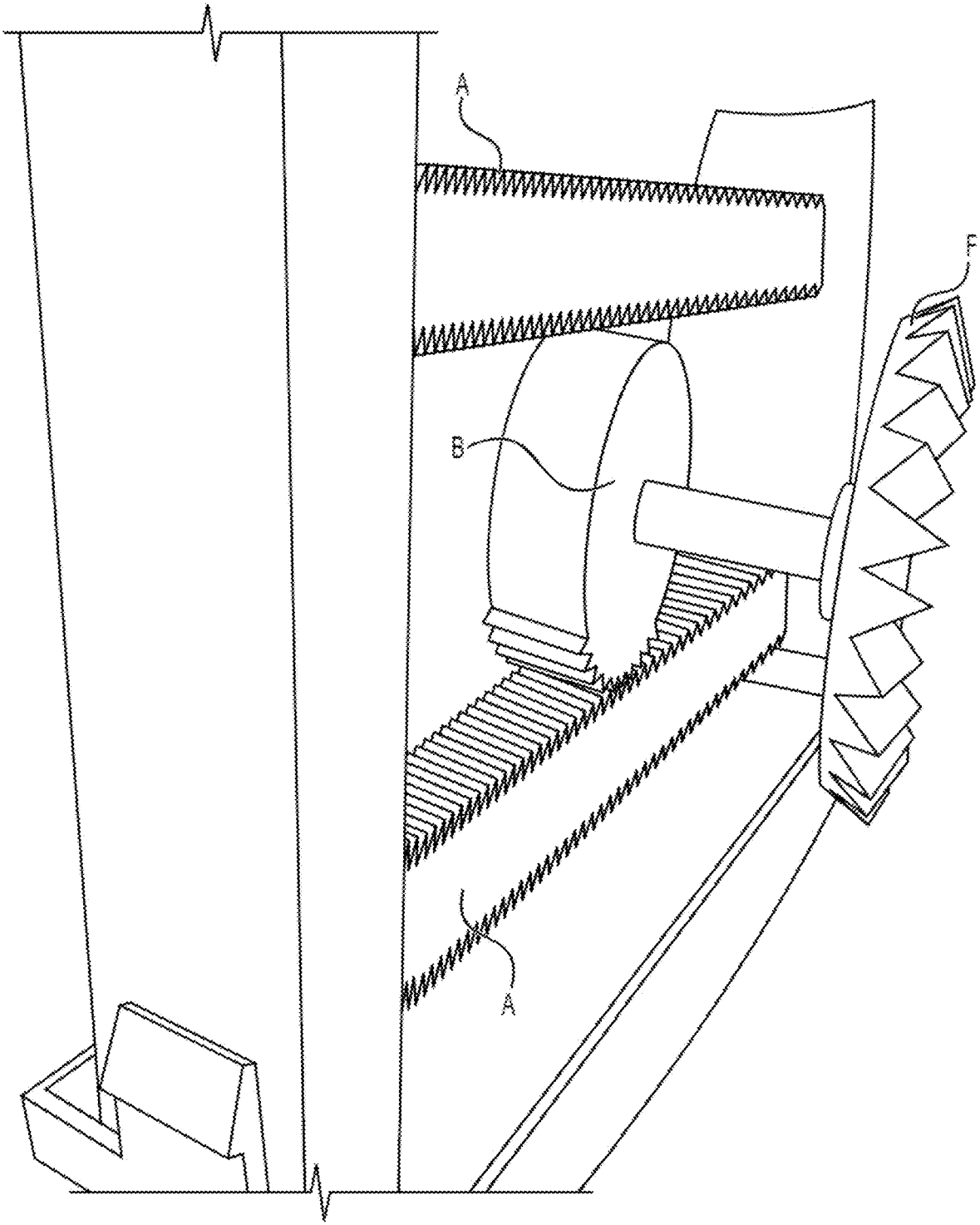
Figure 6:
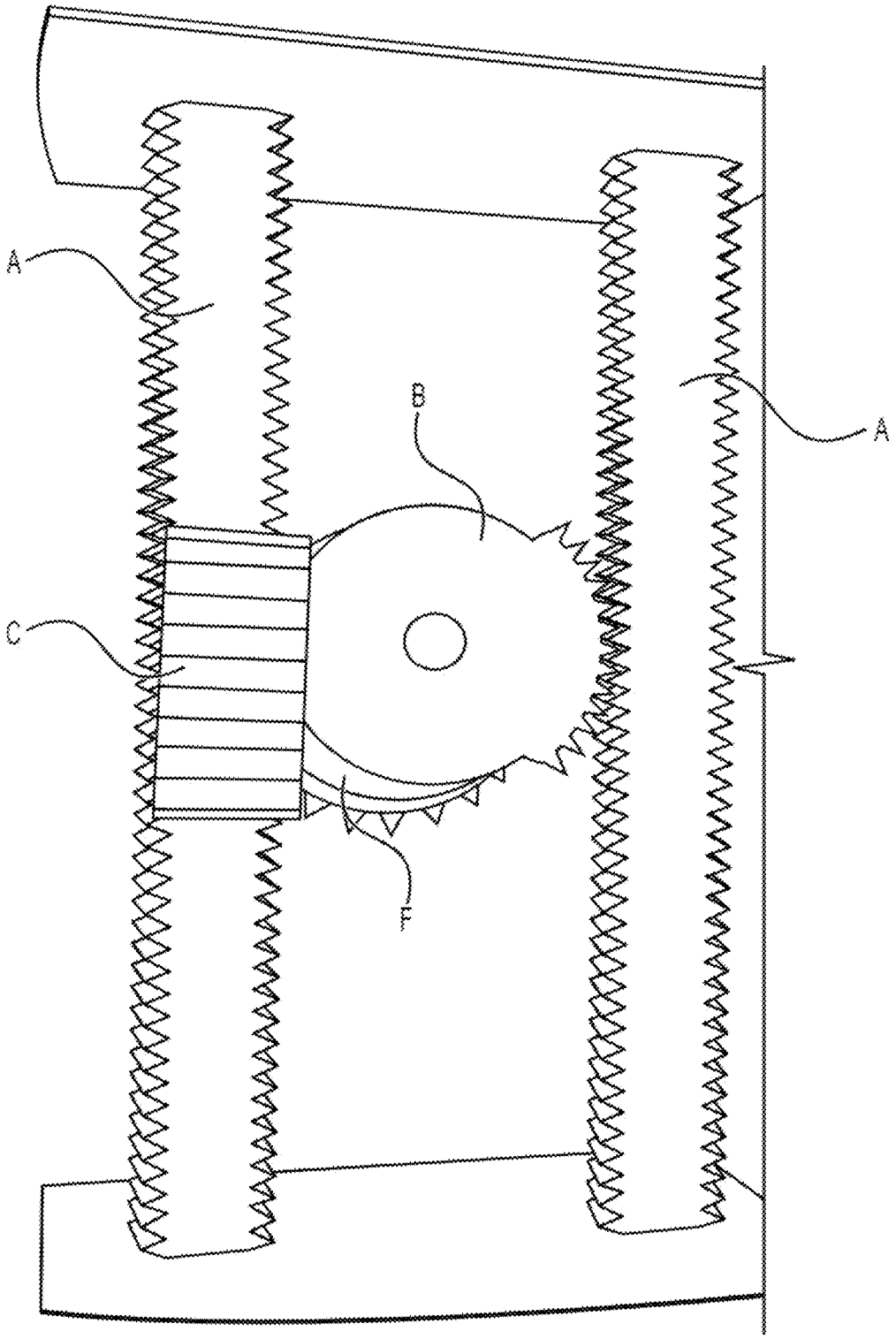

Six versions of the same FIG. 4 can be used as follows. Four for the pectoral fins, two for each side, and one for the head and tail of the fish, which also needs a small linear gear on the side of the linear gear, such as the linear gear M, to give a reciprocating motion to the circular gears, such as gears D and P, and the shaft connected to them vertically, which gives the reciprocating motion to the robotic fish's tail and head. (See FIGS. 5 and 6).

Figure 7A:
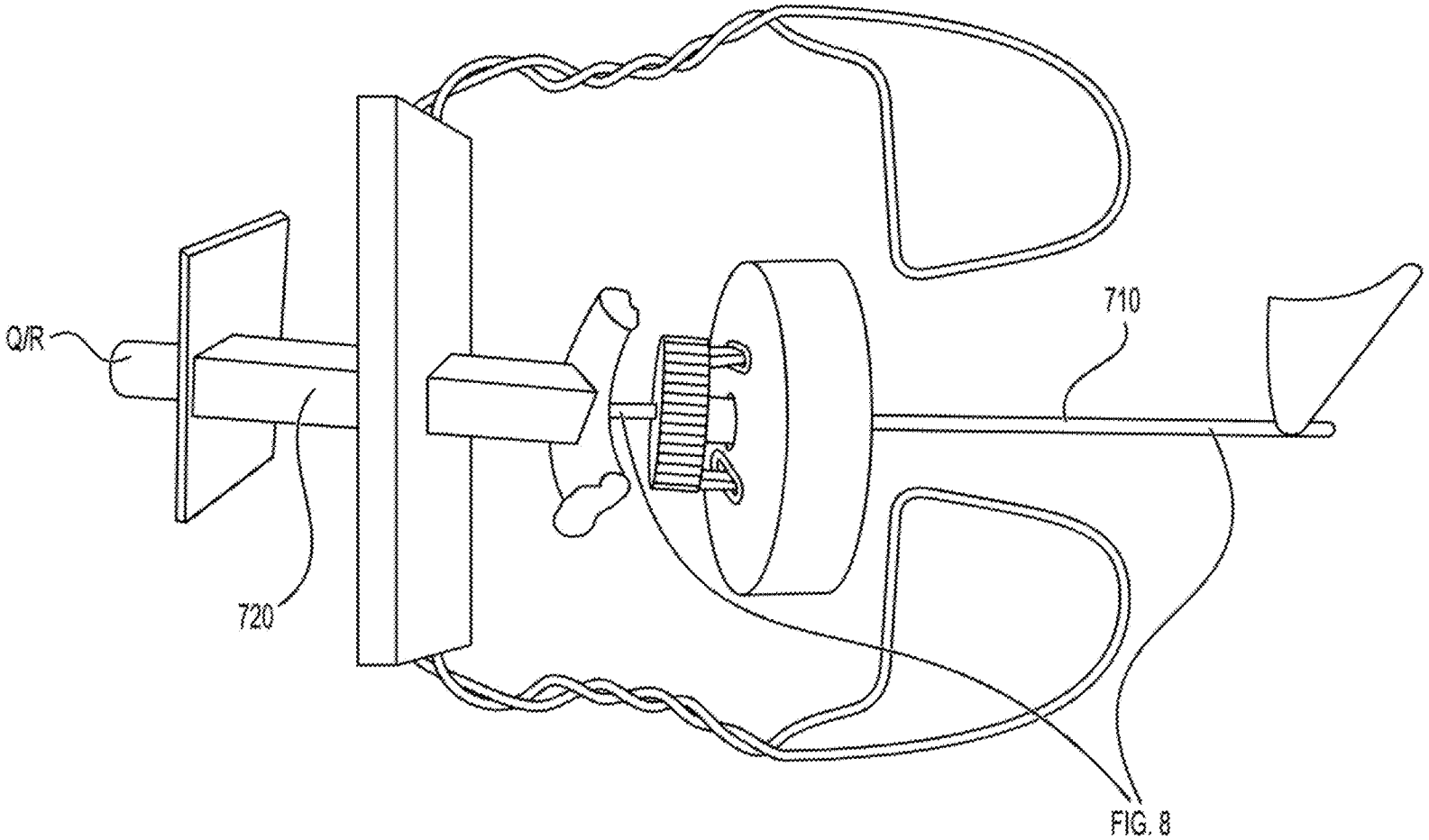
FIG. 7A is an illustration of an engaging/disengaging part and a direction change part.

FIG. 7A is an illustration of the part for attaching the fin to the movement or disconnecting it from the movement as well as the part for changing its direction. Two columns 710,720 are manufactured as shown in the illustration. The shaft 710 is connected to the motion via the upper gearbox (upper bevel gearbox) by an internally toothed cylinder that connects the pectoral fin shaft (see FIG. 8 segmented shaft) and the externally toothed shaft connected to the upper gearbox.

Figure 7C:
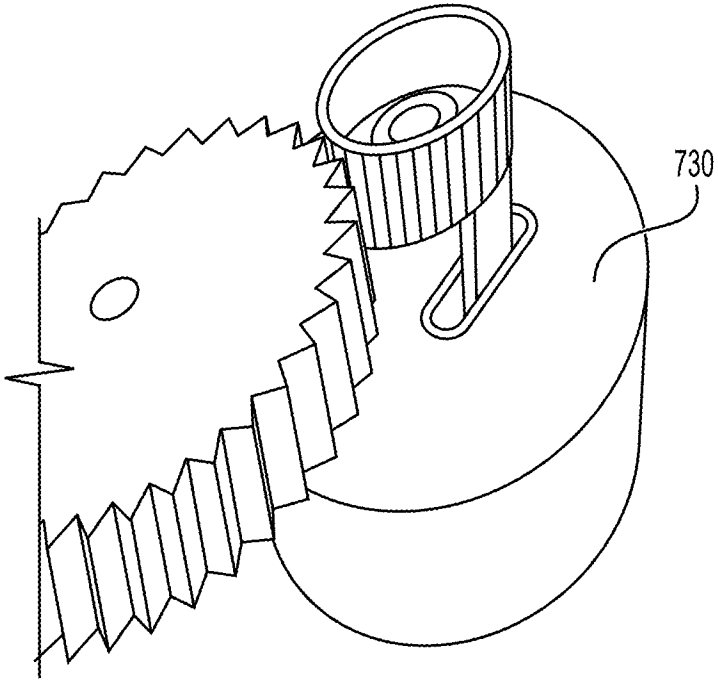
FIGS. 7B, 7C, 7D and 7E are illustrations of the direction changing part.
Figure 7B:
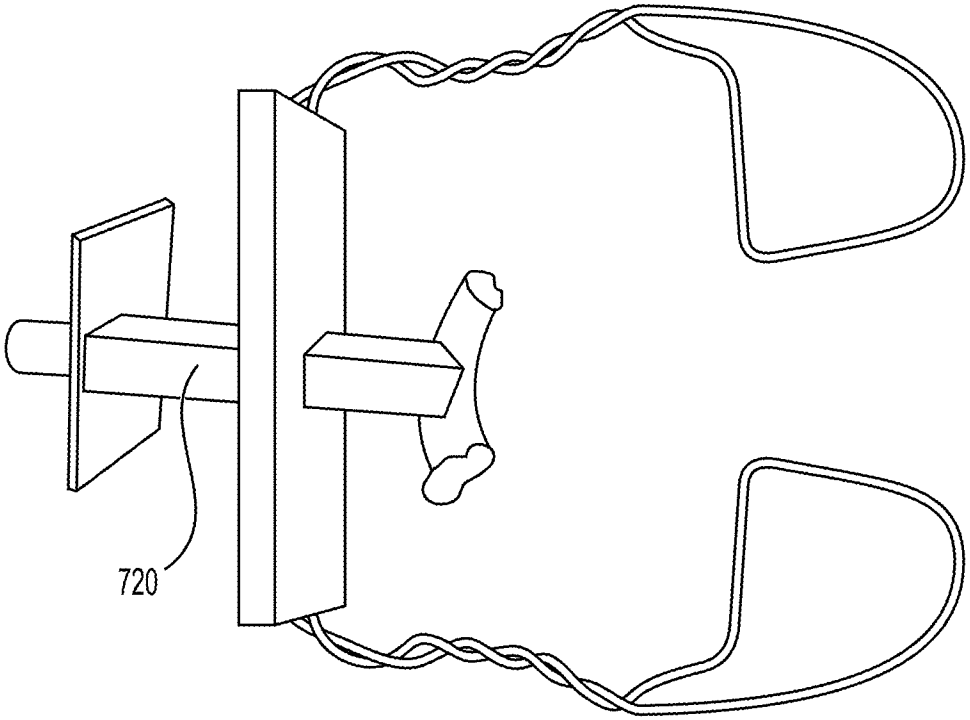
Figure 7E:
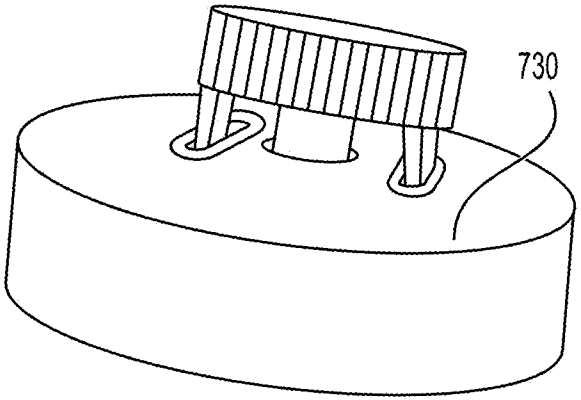
Figure 7D:
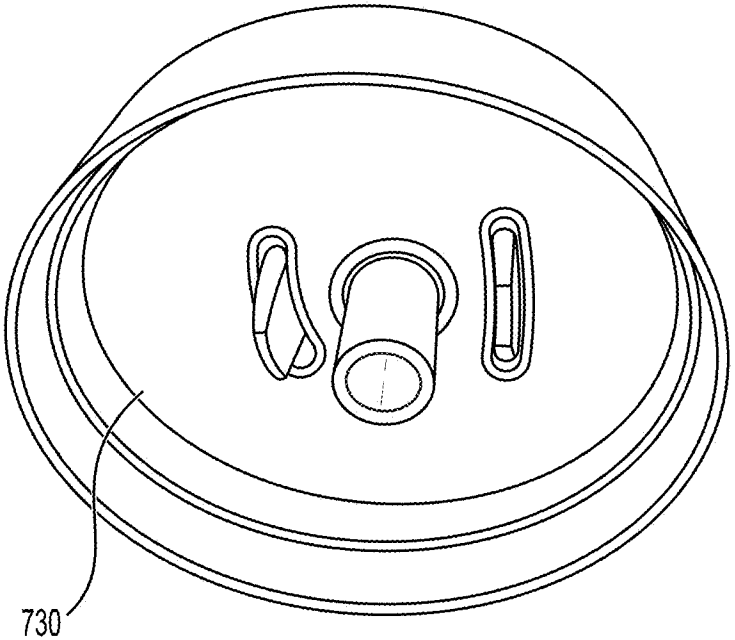
Figure 8:
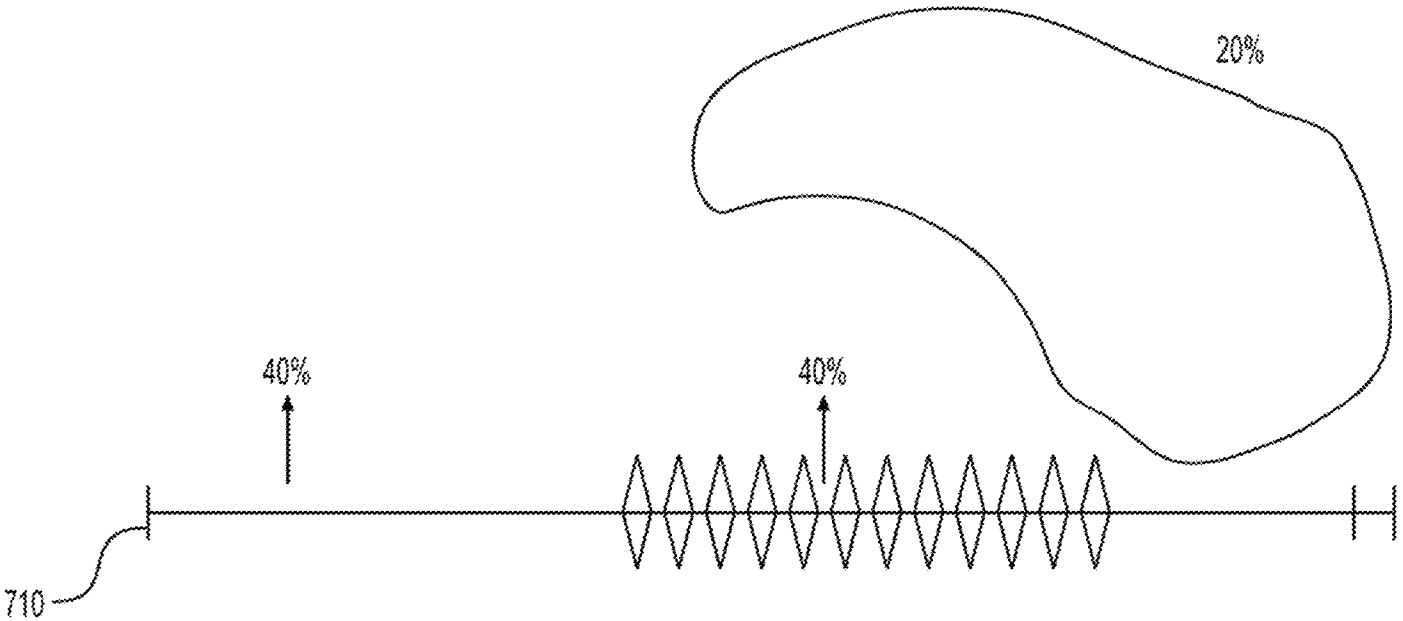
FIG. 8 is an illustration of a cylindrical shaft dividing 20% non-toothed (non-gear), 40% externally toothed, 40% non-toothed (non-geared).

The second shaft 720 is an internally toothed cylinder which internally connects the pectoral fin shaft (the segmented shaft of FIG. 8) and the externally toothed shaft connected to the upper gearbox (see FIG. 7B). Two parts are welded to the internally toothed cylinder at both ends, and a third free moving part is placed in the middle linked to a motor to drive the welded parts to separate and engage the fin by oscillatory movement, and engage and separate the part to change the direction of the pectoral fin (see FIGS. 7C, 7D, 7E). The direction changing portion 730 is separated from the serrated portion of the dividing shaft when the fin is engaged in reciprocating motion, and is connected to the serrated portion of the dividing shaft when the reciprocating motion is separated from the pectoral fin, and in the center of the direction changing portion is an internally toothed cylinder. This divided shaft, as illustrated in FIG. 8, has a 40% non-toothed (non-gear) portion, a 40% externally toothed portion, and a 20% non-toothed (non-gear) portion. Part or all of this system can be applied to other parts such as the head and tail.

An artificial brain and sensors are also added to control the movement of the robotic fish.

The robotic fish, in one embodiment, includes two linear gears attached to each other that move by means of a quarter circular gear, forming an oscillatory movement, and connected to them is a small linear gear horizontally on the side of one of the two linear gears or both together, transmitting the oscillatory movement to a horizontal circular gear linked to a vertical shaft that oscillates, and this vertical shaft is connected to the tail of the fish. The mechanism, and a quarter of the circular gear is connected to a shaft, and this shaft is connected to a bevel gear and is moved by another bevel gear that takes the mechanical movement from the main engine, and on the other side is another bevel gear linked to a shaft, and this shaft is connected to a quarter of a circular gear, and this quarter of the circular gear moves two linear gears fixed together, forming a movement.

A small linear gear horizontally on the side of one of the two linear gears or both together transmits the oscillatory movement to a horizontal circular gear linked to a vertical shaft that oscillates, and this vertical shaft is connected to the head of the robotic fish.

As for the pectoral fins, their oscillatory movement is taken from the top or bottom of the two linear gears by means of a circular gear linked to a shaft, and this shaft is connected to a bevel gear, and this bevel gear is connected to two bevel gears on both sides, to give the oscillatory movement to the right and left pectoral fins.

It is to be understood that the present subject matter is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A robotic fish, comprising:

a pair of rear linear gears controlling a rear portion of the robotic fish;

a pair of front linear gears controlling a front portion of the robotic fish;

a right side bevel gear controlling a right pectoral side of the robotic fish;

a left side bevel gear controlling a left pectoral side of the robotic fish; and a head on the front portion of the robotic fish, the head having a front ring gear in communication with the pair of front lateral gears.

2. The robotic fish as recited in claim 1, further comprising a tail on the rear portion of the robotic fish, the tail having a tail ring gear in communication with the pair of rear linear gears.

3. The robotic fish as recited in claim 1, further comprising a left pectoral fin on the left pectoral side of the robotic fish, the left pectoral fin having a left pectoral ring gear in communication with the left side bevel gear.

4. The robotic fish as recited in claim 1, further comprising a right pectoral fin on the right pectoral side of the robotic fish, the right pectoral fin having a right pectoral ring gear in communication with the right side bevel gear.

5. A robotic fish, comprising:

a pair of rear linear gears controlling a rear portion of the robotic fish;

a tail on the rear portion of the robotic fish, the tail having a tail ring gear in communication with the pair of rear linear gears;

a pair of front linear gears controlling a front portion of the robotic fish;

a head on the front portion of the robotic fish, the head having a front ring gear in communication with the pair of front linear gears;

a right side bevel gear controlling a right pectoral side of the robotic fish;

a right pectoral fin on the right pectoral side of the robotic fish, the right pectoral fin having a right pectoral ring gear in communication with the right side bevel gear;

a left side bevel gear controlling a left pectoral side of the robotic fish; and a left pectoral fin on the left pectoral side of the robotic fish, the left pectoral fin having a left pectoral ring gear in communication with the left side bevel gear.

* * * * *